US006054215A

United States Patent [19]

Son et al.

[11] Patent Number: 6,054,215

[45] Date of Patent: Apr. 25, 2000

[54] DISPERSE DYEABLE POLYPROPYLENE FIBERS AND ITS METHOD OF MANUFACTURE

[75] Inventors: Tae Won Son; Sang Gyu Lim; Jun Ho Park, all of Taegu, Rep. of Korea

[73] Assignee: Tae Won Son, Taegu, Rep. of Korea

[21] Appl. No.: 09/303,570

[22] Filed: May 3, 1999

[30] Foreign Application Priority Data

May 4, 1998 [KR] Rep. of Korea ..... 98 16373

[51] Int. Cl.[7] ..... D01F 6/06

[52] U.S. Cl. ..... 428/364; 428/394

[58] Field of Search ..... 428/364, 394

[56] References Cited

U.S. PATENT DOCUMENTS 5,447,539 9/1995 Kelly et al. ..... 8/485

FOREIGN PATENT DOCUMENTS 0468519 1/1992 European Pat. Off. .
0625538 11/1994 European Pat. Off. .
2242390 10/1991 United Kingdom .
9409067 4/1994 WIPO .

OTHER PUBLICATIONS

"Polymeric Dye Receptors for Disperse Dyeable Polypropylene Fibers", H. Dayioglue; Journal of Applied Polymer Science, vol. 46, pp. 1539–1545 (1992).

"The Coloration of Polypropylene Fibres with Acid Dyes", J. Akrman and M. Kaplanova, JSDC, vol. 111, May, 1995, pp. 159–163.

"Dyeing Polypropylene Fibres by Means of Copolymer Additives", Sung Il Hong, Sung Tae Kim and Taek Seung Lee, JSDC, vol. 110, Jan., 1994, pp. 19–23.

"Blending Polypropylene with Hydrogenated Oligocyclopentadiene: A New Method for the Production of Dyeable Fibers", A. Seves, T. De Marco, A. Siciliano, Dyes and Pigments, vol. 28, No. 4, pp. 19–29 (1995).

*Primary Examiner*—Newton Edwards

[57] ABSTRACT

Diverse dyeable polypropylene fibers are manufactured by making polypropylene resin composition chips by dispersing 100 parts by weight of polypropylene, 1–10 parts by weight of semi-crystalline functional high polymer, 0.05–5 parts by weight of amorphous functional polymer, and 0.1–3 parts by weight additives and melting and spinning the polypropylene resin composition chips.

7 Claims, 1 Drawing Sheet

Contained quantity of ethylene-vinylacetate copolymer(wt%).

DISPERSE DYEABLE POLYPROPYLENE FIBERS AND ITS METHOD OF MANUFACTURE

BACKGROUND OF THE INVENTION

1. Field of the Invention

The present invention relates to novel polypropylene fibers which are manufactured by equally compounding functional polymeric materials of dyeability to the none-dyeable polypropylene. More particularly, the present invention relates to obtain the disperse dyeable polypropylene fibers by compounding more than two functional polymeric materials to the polypropylene, the main material represented in the following formula (1)

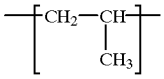

(1)

2. Description of the Related Art

Generally it is impossible to give colors into polypropylene fiber by conventional dyeing techniques. But to make it possible, the polypropylene fiber has to be functional to absorb dyes. That is, it is necessary to give the function to the polypropylene fiber so that it can absorb dyes in order to dye polypropylene fiber after spinning it by conventional dyeing method.

There are five known methods which high polymeric material is compounded into the polypropylene.

(1) Hong Sung-il has ever mixed stearylmethacrylate copolymer with polypropylene to improve the dyeability of polypropylene. (J.Soc. Dyers Colour., Vol. 110, p 19–23, 1994)

(2) Wilpers D. J. mixed polybutene which is functional with anhydride, carboxylate, and acrylate, etc into polypropylene. (PCT Int'l. Appl. 9409067 All, Apr. 28, 1994).

(3) Seves A. mixed oligocyclopentadiene into polypropylene. (Dyes Pigm., Vol. 28(1) p 19–29, 1995)

(4) Dayiogu H. mixed styrene-2 vinylpyridine copolymer into polypropylene. (J. Appl. Polym. Sc., V. 46(9), p 1539–1545, 1995).

(5) Tietz R. F. mixed polyamide into polypropylene. (Eur. Pat. Appl. 468519 Al., Jan. 29, 1992)

In order to give the color into polypropylene, it is conventional to add and mix some granule-type pigment into melt polypropylene like Laverty Ko J. (Brit. UK Pat. Appl. 2242390, Oct. 2, 1991).

There are also another known examples to give colors into polypropylene fiber.

(1) Akrman J. manufactured fiber which is dyeable at acid dyes. (J. Soc. Dyers Colour., Vol. 111, p 159–163, 1995).

(2) Kelly D. R. dyed polypropylene fiber at disperse dyes with dyeability increasing agent. (U.S. Pat. No. 5,447,539, Sep. 5, 1995)

(3) Mallonee W. C. gave dyeability to polypropylene fiber by mixing functional additives into polypropylene. (Int'l. Fiber J. Vol. 11(5), P 24–29, 1996)

(4) Hishida I. Manufactured colorful thermoplastic resin ship by mixing powder-type pigment into polypropylene with thermoplastic copolymeric additives. (Eur. Pat. Appl. 625538 A1., Nov. 23, 1994)

However, as shown above so far, to give a function to polypropylene fiber is only to mix functional polymers into polypropylene. It means that it is impossible to expect manufacturing resinoid to maximize a chemical attraction with disperse dyes as the functional polymer itself is very limited in a certain function.

SUMMARY OF THE INVENTION

Accordingly, it is an object of the present invention to provide a novel disperse dyeable polypropylene fiber which is manufactured by equally compounding functional polymeric materials of dyeability to the no-dyeable polypropylene, which eliminates the above problems encountered with conventional disperse dyeable polypropylene fibers.

Another object of the present invention is to provide a method for the preparation of the disperse dyeable polypropylene fiber manufactured by compounding the functional and amorphous polymeric materials, low crystalline polymeric materials, and other property improving additives into the non-polar high crystalline polypropylene, and by dispersively penetrating them into the amorphous sites of the polypropylene.

A further object of the present invention is to provide a novel polypropylene fiber has the aromatic, ester, ether and hydroxy radical all together and a new characteristic property to dye even the deep color to polypropylene fiber by a conventional dyeing method.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art form this detailed description.

Briefly described, the present invention relates to a disperse dyeable polypropylene fiber filter by mixing the functional polymeric materials which are attractive with disperse dyes, with polypropylene, giving it dyes absorbing function, spinning the functional polypropylene resin, and then manufacturing it to be fiber.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
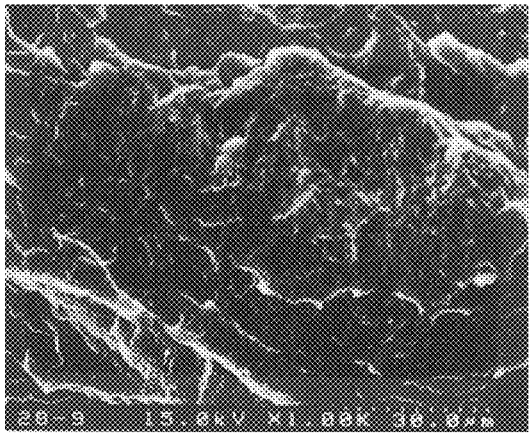
FIG. 1 is an electron microscope picture of the fractured surface of polypropylene resin composition which is compounded with weight 93% of polypropylene, 7% of ethylene-vinylacetate copolymer, and 1% of polyhydroxyether. This represents the state in which ethylene-vinylacetate copolymer and polyhydroxyether are equally dispersed in the polypropylene.
Figure 2:
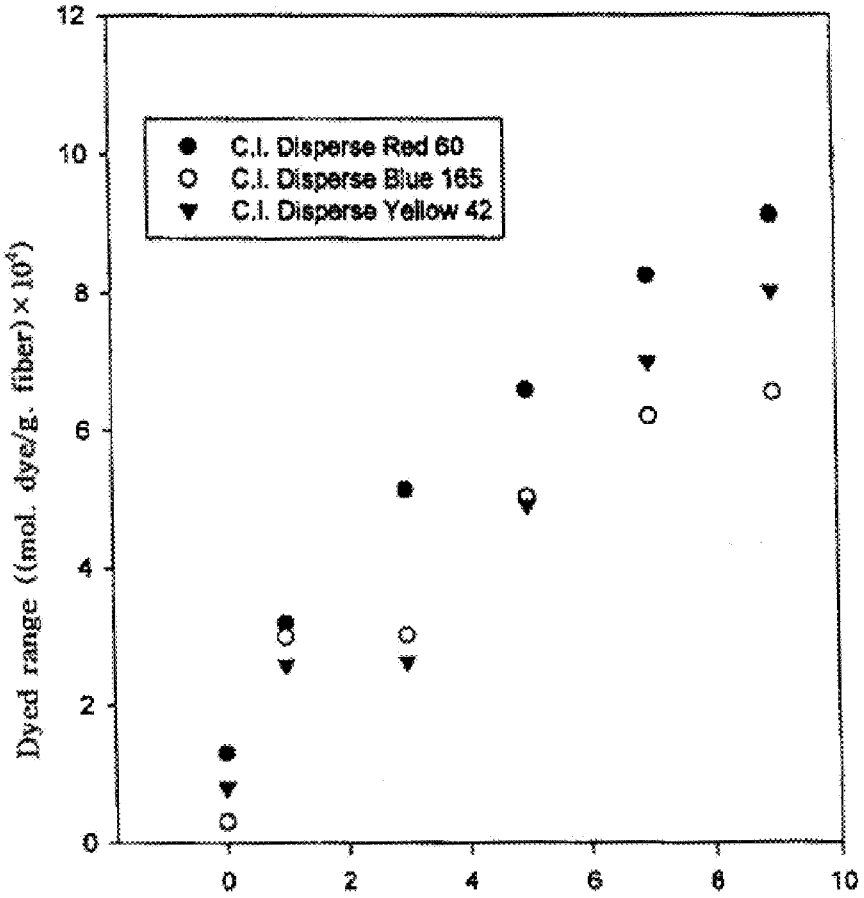
FIG. 2 is the graph which shows the dyeability of disperse dyeable polypropylene fiber of this invention. The disperse dyeable polypropylene fiber of the present invention displays dyeable of 2–10 times more in disperse dyes comparing with the conventional polypropylene fibers.

Referring now in detail to the drawings for the purpose of illustrating preferred embodiments of the present invention, the process for the preparation of a novel disperse dyeable polypropylene fiber represented by the following formula (1) as shown in FIGS. 1 and 2, comprises the steps of mixing semi-crystalline functional polymeric materials which are attractive with disperse dyes with polypropylene; giving it dyes absorbing function; spinning the functional polypropylene resin; and manufacturing it to be the fiber of the present invention.

(1)

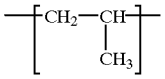

As the semi-crystalline functional polymer adding to give the function to polypropylene fiber is composed of high elastic polymer like rubber, the polypropylene fiber of the present invention is much more superior to the conventional polypropylene fiber in its softness and elasticity.

In the novel fiber, crystalline polypropylene keeps well-mixed state by the operation of semi-crystalline functional polymer and amorphous functional polymer. And their mutual operations makes it possible to present dyeable function as the absorption and the penetration of dyes are easy.

Further, as other polymeric materials are equally dispersed in the polypropylene, physical property of the polypropylene fiber is well kept and the functions, such as dyeability, absorption, affinity are greatly improved.

Especially, the fiber of the present invention is amorphous functional polymer, and it contains polyhydroxyether represented by the following formula (2). Therefore, even the deep color is possible dyed by greatly improving the dye absorbing and penetrating function to polypropylene fiber because it has the aromatic, ether and hydroxy group of which the mutual operation of semi-crystalline functional polymer and polypropylene is possible.

(2)

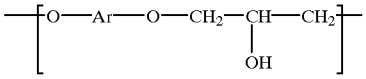

Dyeable fiber of multi-ingredient polypropylene in which 100 of polypropylene, 0.5–5 of amorphous functional polymer, and 1–10 of semi-crystalline functional polymeric copolymer are equally and dispersively compounded is availably provided by the present invention.

By the present invention, polypropylene is isotactic-type. And the molecular weight per average weight is 10,000–1,000,000, and the melt index by ASTM D1238 testing method is 1 g/10 min.–100 g/10 min.

Also, amorphous functional polymer is the polyhydroxyether manufactured to be linear polymer after having the 4,4'-isopropylidenediphenol and ipichlorohydrine react by stoichiometric ratio. It has molecular structure represented by the following formula (3), and the molecular weight per average weight is between 1,000–50,000, or epoxy resin, novolak-type phenol-formaldehyde resin, and those mixtures can be used for it.

(3)

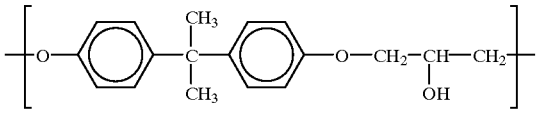

Epoxy resin is the oligomer of low molecular weight manufactured by reacting of aromatic diol and epichlorohydrine, and its polymerized degree is 1–5.

As for the aromatic diol in this meaning, such 4,4'-ispropylidenediphenol, resolcinol, hydroquinon, 4,4'-dihydroxydiphenol, 4,4'-dimethylenediphenol, 4,4'-dihydroxydiphenylsulfide, etc. can be used, especially among them, 4,4'-isopropylidenediphenol and resolcinol are mostly advisable.

Also novolak type phenol-formaldehyde resin is the oligomer of low molecular weight manufactured by reacting of phenol and formaldehyde in acidic catalyst, and its softening point is between 50° C.–150° C.

(4)

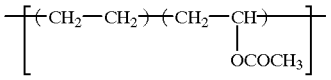

Semi-crystalline functional polymer is ethylene vinylacetate copolymer represented by the above formula (4), and vinylacetate content is between mole ration 10%–50%, and melt index is 1.0 g/10 min–400 g/10 min. And for the semi-crystalline functional polymer, such ethylene-vinylalcohol copolymer, acryl copolymer, polyester copolymer, and polyamid copolymer can be used.

Also for the additives in order to give physical, thermal, optical stability, and chemical function to polypropylene, thermal stabilizer, optical stabilizer, ultraviolet light stabilizer, resist, softener, wetting agent, compatibilizer, plasticizer, and anti-static agent can be used.

These additives are to supplement the weak point of polypropylene, and can be possibly chosen among the goods being widely used in general.

Polypropylene resin composition of this invention is produced by mixing 100 of polypropylene, weight ratio 1–10 of semi-crystalline functional polymer, 0.5–5 of amorphous functional polymer, and 0.1–3 of additives in the melt form of 180° C.–240° C. until they become completely melt/mixed material by melt mixing unit.

Sigma mixer, brabender, single screw extruder, twin screw extruder, and compounder are used for the mixing units. And especially, compounder and twin screw extruder are advisable to more effectively carry out the mechanical mixing.

Polypropylene resin composition of this invention shows fractured surface in which polypropylene and polar polymeric material are mixed evenly among all as shown in the formula (1) when searching it with microscope, and there is no uneven phase by phase separation.

Melting temperature of this polypropylene resin composition is 160° C.–180° C. and its crystallization temperature is 100° C.–150° C., and the polar polymeric material and additives are evenly dispersed in the amorphous site of polypropylene. So the phase separation is not obviously presented, and the contact angle is 1° C.–30° C. lower than pure polypropylene when we measure the contact angle on the surface of flat specimen.

The polypropylene fiber the present invention is manufactured by puttying the polypropylene resin composition into the melt spinning unit which has a spinneret of spinning hole diameter between 0.1 mm–1 mm; spinning it at spinning temperature 180° C.–240° C. and spinning speed 500 m/min.–6,000 m/min.; and drawing it twice-6 times at 20° C.–150° C.

In the polypropylene fiber of the present invention, density is 0/9 g/cm$^3$, thickness of mono-filament is 0.5 denier-50 denier, intensity is 2 g/denier-10 g/denier, modulus is 10 g/denier-100 g/denier, elongation is 5%–100%, and elastic recovery is 80%–99%,and crystal diffraction peak formed by mixed amorphous functional polymer and semi-crystalline functional polymer is not appeared.

Consequently, it has an excellent property to epochally increase the absorption of disperse dyes than conventional fiber.

The conventional polypropylene fiber has the dyeability of maximum $1.0\times10^4$mol/g when dyeing it with disperse dyes, but this new fiber shows the dyeable surface between $3.0\times120^{-4}$mol/g–$12\times10^4$mol/g.

To search for the dyeability of this new disperse dyeable polypropylene fiber, it is dyed by high temperature and high pressure dyeing machine (Mathis Labomat Beaker Dyer Type BFA-8/16, Wermer Mathis AGCO Co.) after adding 1% o.w.f. dispersal agent with 3 kinds of disperse dyes (C.I. Disperse Red 60, Yellow 42, or Blue 165) at 0.2 g/bath.

Dyeability is also examined by measuring the light absorption with spectrophotometer (Spectronic Genesys 5, Milton Roy Co.) after drawing the reduction curve and extracting the dyed material with pyridine in order to confirm the absorption of dyes in the dyed fiber.

It puts the fiber and dyes with additives into the high pressure dyeing machine, increased the temperature from 50° C. to 130° C. at the increasing speed of temperature 2.7° C./min., kept it for 40 minutes at 130° C., and then reduced the temperature to 85° C. at reducing speed 3° C./min.

After then, the dyed fiber was reductive-washed with NaOH 1 g/, Na2804 1 g/, and non-ionic detergent for 20 minutes at 80° C.

All over the every disperse dyes can be used for this work including following dyes;

*Anthraquinone type disperse dyes:
C.I. Disperse Red 60, Blue 60, Violet 26, Red 92, Blue 165,

*Azo type disperse dyes:
C.I. Disperse Red 184, Red 343, Blue 79, Blue 367, Orange 73, Red 371,

*Mono-azo type disperse dyes:
C.I. Disperse Red 54, Red 50, Red 73, Blue 183, Yellow 235, Red 202,

*Nitro type disperse dyes: C.I. Disperse Yellow 42,

*Quinoline type disperse dyes: C.I. Disperse Yellow 54,

*Methine type disperse dyes: C.I. Disperse Blue 354, etc.

It is measured the changes of hyrdophile property of the polypropylene resin composition 10 times/specimen and compared the result with one another. At this time, contact angle measuring machine (ERMA contact angle meter G40, ERMA Co.) and Bris contact angle measuring method were used for this works.

It is measured the density of this functional polypropylene fiber by floating method at 25° C. with the mixture of carbonitetracholoride ($CCl_4$) and _heptane, and removed the bubble remains on the surface of the specimen in low pressure state after putting the specimen into mixed solution.

The present invention will now be described in more detail in connection with the following examples which should be considered as being exemplary and not limiting the present invention.

EXAMPLE 1

Polypropylene(MI=25) 4.65 kg, ethylene vinylacetate copolymer(vinylacetate 28% included) 0.35 kg, and polyhydroxyether 0.05 kg put to twin screw compounder(Warner & Pfleiderer, Type ZSK 25). Thereafter, mixed them at temperature of 180° C.–210° C., screw speed of 250 rpm, and extruding ratio of 15 kg/h; and makes chips from the functional polypropylene resin composition after the mixture became the composition. After then the composition chips of above put to melt spinning unit (Korea Spin-draw M/C) in which spinning pack is installed wherein the spinning hole diameter of the spinning pack is 0.5 mm and spinning holes are 60; spins it at spinning temperature of 220° C., extruding ratio of 198/min., and winding speed of 1500 m/min; and then manufactured it fiber by drawing it at temperature 95° C. and draw-ratio 3.8.

The properties of the present fiber are thickness of mono filament: 2.1 denier; intensity: 3.8 g/denier; elastic ratio: 21.4 g/denier; elongation: 30.1%; density: 0.912 g/cm$^2$; and absorption ratio to disperse dyes: $6.6\times10^{-4}$mol/g–$8.4\times10^{-4}$mol/g.

EXAMPLE 2

Polypropylene(MI=25) 4.75 kg, ethylene-vinylacetate copolymer 0.25 kg, and polyhydroxyether 0.05 kg put to the twin screw compounder (Warner & Pfleiderer, type ZSK 25), and mixed them at temperature of 180° C.–210° C., screw speed of 250 rpm, and extruding ratio of 15 kg/h.

Thereafter chips are made from the functional polypropylene resin composition after the mixture becomes the composition, makes the composition chips of above put to melt spinning unit (Korea Spin-draw M/C) in which a spinning pack is installed (spinning hose diameter of the spinning pack is 0.5 mm and the spinning holes are 60); spin it at spinning temperature of 220° C., extruding ratio of 19 g/min., winding speed of 1,500 m/min.; and makes it to be fiber by drawing at drawing temperature of 95° C. and draw ratio of 3.8.

The properties of the present fiber are thickness of monofilament: 1.9 denier; intensity: 4.1 g/denier; elastic ratio: 23.7 g/denier; elongation: 25.5%; density 0.91 g/cm$^3$) and absorption ratio to disperse dyes: $4.2\times10^4$ mol/g~$6.3\times10^4$ mol/g.

EXAMPLE 3

Polypropylene(MI=25) 4.65 kg, ethylene-vinylacetate copolymer 0.35 kg, and phenol formaldehyde resin 0.05 kg put to twin screw compounder (Warner & Pfleiderer, type ZSK 25), and mixes them at a temperature of 180° C.~210° C., screw speed of 250 rpm, and extruding ratio of 15 kg/h; makes chips from the functional polypropylene resin composition after the mixture became the composition; puts the composition chips of above into melt spinning unit (Korea Spin-draw M/C) in which a spinning pack is installed wherein the spinning hole diameter of the spinning pack is 0.5 mm and spinning holes are 60; and makes it at spinning temperature of 220° C., extruding ratio of 19 g/min., winding speed of 1,500 m/min.; and makes it to be fiber by drawing at drawing temperature of 95° C. and draw ratio of 3.8.

The properties of the present fibers are thickness of monofilament: 2.4 denier; intensity: 3.4 g/denier; elastic ratio: 23.0 g/denier; elongation: 24.7%; density 0.91 g/cm$^3$, and absorption ratio to disperse dyes: $5.2\times10^4$ mol/g~$6.8\times10^4$ mol/g.

EXAMPLE 4

Polypropylene(MI=25) 4.65 kg, ethylene-vinylacetate copolymer 0.35 kg, and phenol formaldehyde resin 0.05 kg put to twin screw compounder (Warner & Pfleiderer, type ZSK 25), and mixes them at a temperature of 180° C.~210° C., screw speed of 250 rpm, and extruding ratio of 15 kg/h; makes the chips from the functional polypropylene resin composition after the mixture became the composition; puts the composition chips of above into melt spinning unit (Korea Spin-draw M/C) in which a spinning pack is installed wherein the spinning hole diameter of the spinning pack is 0.5 mm and spinning holes are 60; and spins it at spinning temperature of 220° C., extruding ratio of 19 g/min., winding speed of 1,450 m/min.; and makes it to be fiber by drawing at drawing temperature of 95° C. and draw ratio of 3.4.

The properties of the present fibers are thickness of monofilament: 2.3 denier; intensity: 2.7 g/denier; elastic ratio: 20.3 g/denier; elongation: 21.8%; density 0.91 g/cm$^3$, and absorption ratio to disperse dyes: $5.7\times10^4$ mol/g~$7.1\times10^4$ mol/g.

Accordingly, the disperse dyeable polypropylene fiber according to the present invention is very effectively used in clothing and many industrial fields as it is dyeable polypropylene fiber by disperse dyes which is manufactured by mixing functional amorphous polymeric material, low crystalline polymeric material, and property improving additives with non-polar and high crystalline polypropylene, and compounding it dispersively into the amorphous site of the polypropylene.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A disperse dyeable polypropylene fiber comprising the steps of: making polypropylene resin composition chips by dispersing about 100 parts by weight of polypropylene represented by the following formula (1) and having average molecular weight of 10,000–1,0-00,00, about 1–10 parts by weight of semi-crystalline functional high polymer, about 0.5–5 parts by weight of amorphous functional polymer represented by the following formula (2), and about 0.1–3 parts by weight of additives; and melting and spinning said polypropylene resin composition chips, whereby the disperse dyeable polypropylene fiber is dyeable at density of 0.9 g/cm$^3$~1.0 g/cm$^3$, thickness of 0.5 denier~50 denier, intensity of 2 g/denier~10 g/denier, elastic ratio of 10 g/denier~100 g/denier, elongation of 5%~100% and absorption ratio to disperse dyes of $3.0\times10^4$ mol/g~$12\times10^4$ mol/g (1)

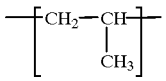

(2)

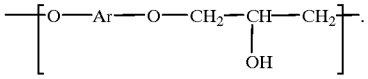

2. The disperse dyeable polypropylene fiber of claim 1, wherein said semi-crystalline functional high polymer is ethylene-vinylacetate copolymer represented by the following formula (4)

(4)

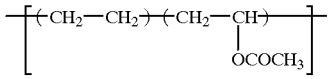

3. The disperse dyeable polypropylene fiber of claim 2, wherein said semi-crystalline functional high polymer is ethylene-vinylacetate copolymer wherein the content of the vinylacetate is 10%~50% and the melt index is 1.0 g/10 min.~400 g/10 min.

4. The disperse dyeable polypropylene fiber of claim 2, wherein said semi-crystalline functional high polymer is a chemical selected from the group consisting of ethylene vinyl alcohol copolymer, acryl copolymer, polyester copolymer, and polyamid copolymer.

5. The disperse dyeable polypropylene fiber of claim 1, wherein the amorphous functional polymer is manufactured in the shape of a linear polymer by reacting 4,4-isopropylidine phenol with ipichlorohydrine in the mole ratio, whereby the amorphous functional polymer is represented by the following formula (3) and has the average molecular weight of 1,000–50,000, the epoxy resin polymerized degree of 1–15, and the softening point of 50° C.–150° C. as novolak-type phenol-formaldehyde resin (3)

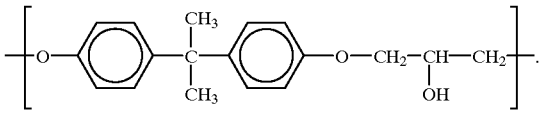

6. The disperse dyeable polypropylene fiber of claim 1, wherein said additives are at least one of thermal stabilizer, optical stabilizer, resist, ultraviolet light stabilizer, softener, wetting agent, compatibilizer, plasticizer, and anti-static agent.

7. A disperse dyeable polypropylene fiber possesses the properties of density of 0.9 g/cm$^3$~1.0 g/cm$^3$, thickness of 0.5 denier~50 denier, intensity of 2 g/denier 10 g/denier, elastic ratio of 10 g/denier~100 g/denier, elongation of 5%~100% and absorption ratio to disperse dyes of $3.0\times10^4$ mol/g~$12\times10^4$ mol/g.

* * * * *